US006080004A

United States Patent [19]

Kovacik et al.

[11] Patent Number: 6,080,004

[45] Date of Patent: Jun. 27, 2000

[54] ELECTRICAL PLUG LOCK

[75] Inventors: James D. Kovacik, Brecksville; Paul S. Blanch, Broadview Heights; Stanley E. Grzywna, Elyria, all of Ohio

[73] Assignee: Alert Safety Lite Products Co., Inc., Bedford Hts., Ohio

[21] Appl. No.: 09/036,973

[22] Filed: Mar. 9, 1998

[51] Int. Cl.[7] ..... H01R 13/62

[52] U.S. Cl. ..... 439/369; 439/352

[58] Field of Search ..... 439/352, 369

[56] References Cited

U.S. PATENT DOCUMENTS

| | | | |
|---|---|---|---|
| 3,014,194 | 6/1961 | Berglund . | |
| 4,143,934 | 3/1979 | Siebert | 339/75 |
| 4,643,505 | 2/1987 | House et al. | 339/75 |
| 4,875,874 | 10/1989 | Windsor, Jr. | 439/364 |
| 5,129,839 | 7/1992 | Vanskiver | 439/367 |
| 5,135,409 | 8/1992 | Thompson | 439/367 |
| 5,393,243 | 2/1995 | Carmo | 439/369 |
| 5,507,664 | 4/1996 | Carmo | 439/372 |
| 5,573,420 | 11/1996 | Grosswendt | 439/371 |

*Primary Examiner*—Paula Bradley
*Assistant Examiner*—Truc Nguyen
*Attorney, Agent, or Firm*—MacMillan, Sobanski & Todd, LLC

[57] ABSTRACT

An electrical connection comprised of a pair of cooperating separable plug members having a separable locking yoke having legs the ends of which are pivotally mounted to boss members formed on one of the plug members and a pair of cooperating spaced apart elements for frictionally engaging the electrical conduit leading away from the other of the plug members.

4 Claims, 3 Drawing Sheets

ELECTRICAL PLUG LOCK

BACKGROUND OF THE INVENTION

1. Field of the Invention

The invention relates to a lock or fastener for preventing the accidental disconnection of separable members of a detachable connecting plug adapted to be connected to a receptacle member having coacting electrical contacts to complete an electrical connection.

2. Prior Art

Heretofore in separable connecting plugs such as those utilized in electrical appliances, electrically driven tools, household appliances, electrically powered vacuum cleaners, and the like, the separable connecting plugs are often accidentally disconnected. The disconnection is typically caused by slight additional strain being placed on the associated electrical cord during the use of the electrical appliance.

SUMMARY OF THE INVENTION

The object of the present invention is to produce an electrical plug lock which may be readily applied to an electrical connection comprised of separable connecting plugs which can eliminate the possibility of the separable plugs from becoming accidentally disconnected.

Another object of the invention is to produce an electrical plug lock for an electrical connection which includes a locking member pivotally mounted to one of the plug members of the connection and may be readily pivotal from an inoperative position to an operative position wherein the locking member frictionally engages the electrical cord of the other one of the plug members.

The objects of the invention are typically achieved by an electrical plug lock for an electrical plug having two separable members comprising a first plug member having electrically conductive prong receiving slots and electrically conductive leads extending therefrom; a second plug member having electrically conductive prongs extending therefrom and electrically conductive leads extending therefrom; boss members extending outwardly from one of the plug members; support arms separably and pivotally attachable to the boss members, the support arms including an interconnecting yoke for partially surrounding the electrically conductive leads of the other plug member when the support arms are pivoted into locking position; and spaced apart friction elements carried by the support arms for frictionally engaging the electrical leads of the other plug member when the support arms are pivoted into locking position.

BRIEF DESCRIPTION OF THE DRAWINGS

The above objects and advantages of the invention will become readily apparent to those skilled in the art from reading the following detailed description in connection with the accompanying drawings, in which.

DETAILED DESCRIPTION OF THE PREFERRED EMBODIMENT

Figure 1:
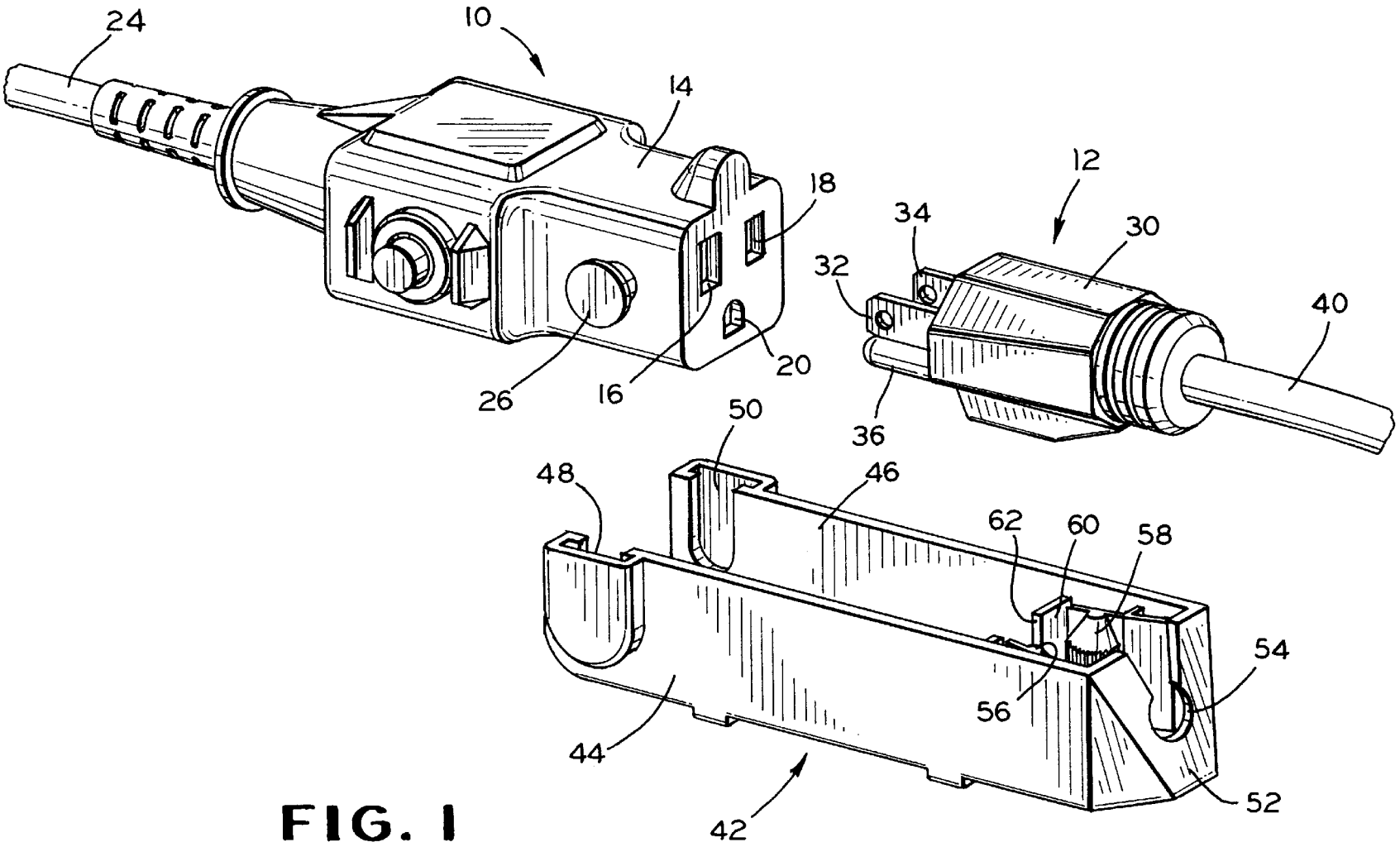
FIG. 1 is an exploded perspective view of an electrical plug lock in accordance with the present invention.

Referring to the drawings, there is illustrated an electrical connection comprised of a pair of separable plug members 10 and 12. The plug member 10 has a main body portion 14 having spaced apart electrical receptacles 16, 18 and 20 electrically connected to respective electrical leads which extend outwardly of the member 10 through an electrical conduit 24.

A pair of outwardly extending diametrically opposed bosses 26 and 28 are formed on the outer surface of the main body portion 14.

The cooperating plug member 12 has a main body portion 30 and outwardly extending spaced apart electrical prongs 32, 34, and 36 electrically connected to respective electrical leads which extend outwardly of the member 12 through an electrical conduit 40. The prongs 32, 34, and 36 of the plug member 12 are formed to be receivable within the receptacles 16, 18, and 20, respectively, of the plug member 10 for completing an electrical circuit.

Figure 2:
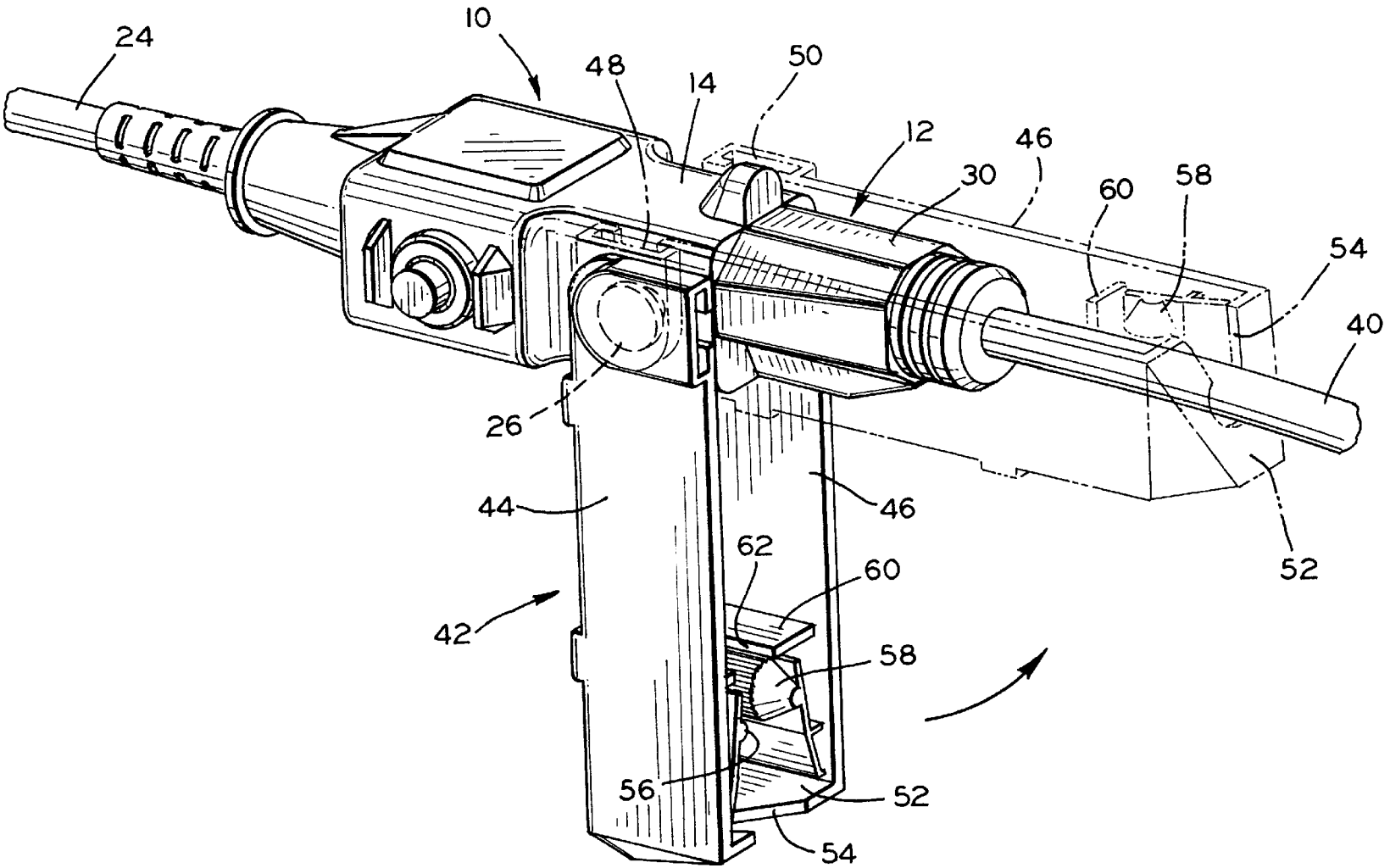
FIG. 2 is a perspective view of the electrical plug lock illustrated in FIG. 1 in an assembled form.
Figure 3:
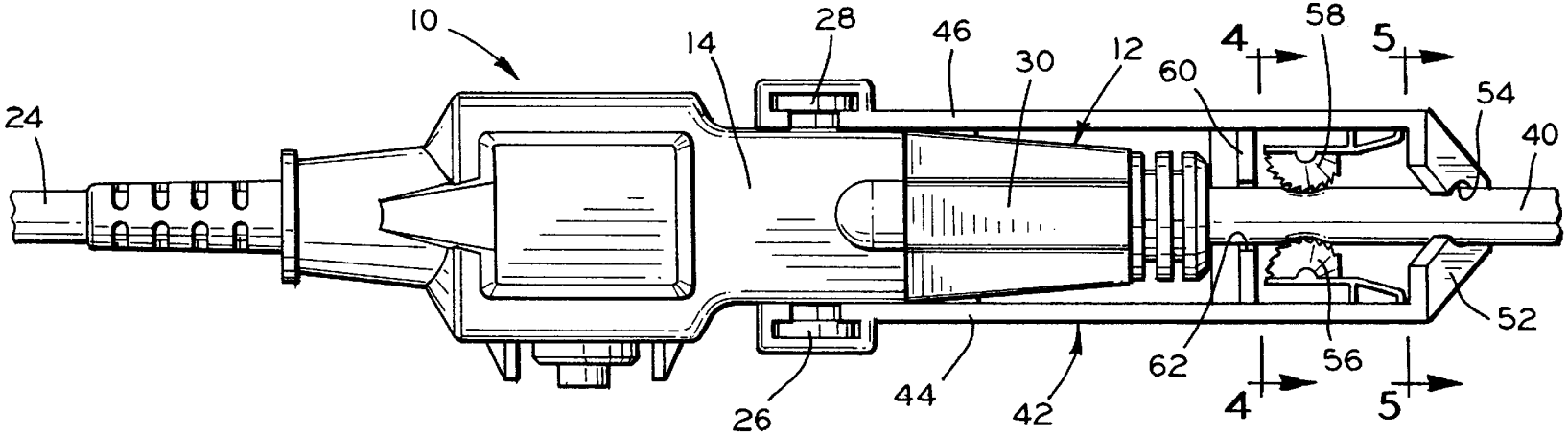
FIG. 3 is a top plan view of the plug lock illustrated in FIG. 2.
Figure 5:
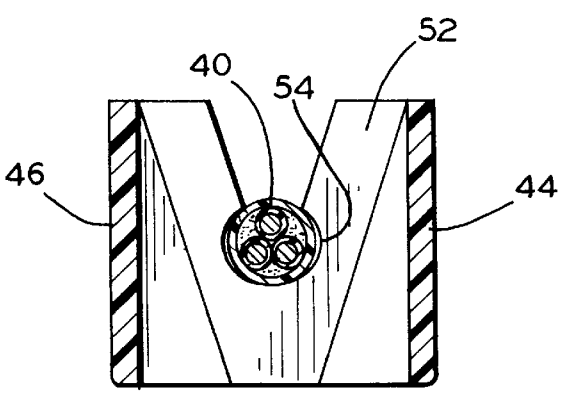
FIG. 5 is a sectional view of the plug lock taken along line 5—5 of FIG. 3.
Figure 4:
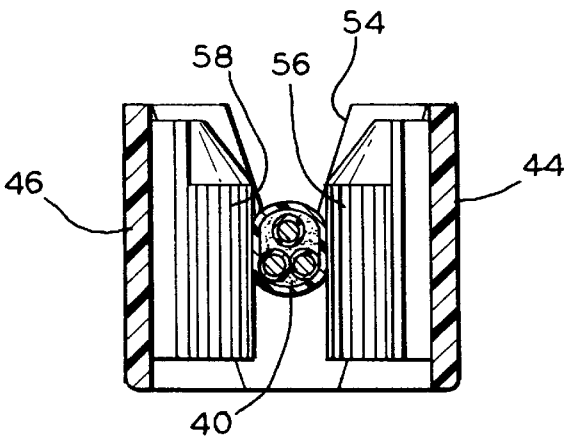
FIG. 4 is a sectional view of the plug lock taken along line 4—4 of FIG. 3.

A locking yoke 42 is separably pivotally mounted to the body portion 14 of the plug member 10. The locking yoke 42 includes a pair of spaced apart leg members 44 and 46, the distal ends of which are provided with sockets 48 and 50, respectively. The sockets 48 and 50 are adapted to be slipped or snapped onto respective bosses 26 and 28. When in the position illustrated in FIGS. 2 and 3, the locking yoke 42 may be readily pivoted from the unlocked position, clearly illustrated in FIG. 2 in full line, and the locked position as shown in phantom in FIG. 2.

The opposite ends of the legs members 44 and 46 are joined together by a wall 52 formed with a pinching slot 54 to readily receive the conduit 40 leading from the main body portion 30 of the plug 12, when the locking yoke 42 is pivoted into an operative locking position.

The locking yoke 42 further includes a pair of spaced apart cooperating ribbed locking segments 56 and 58 which are adapted to receive the conduit 40 therebetween when the yoke 42 is pivoted into a locked position. The configuration of the ribs on the segments 56 and 58 extend generally parallel to one another and perpendicular to the linear axis of the electrical conduit 40. The arrangement permits and facilitates the pivotal positioning of the locking yoke 42 into locked position. When the yoke 42 is in the locked position, the ribbed configuration of the segments 56 and 58 militates against any axial movement of the conduit 40, thereby preventing any accidental disengagement of the plug members 10 and 12.

An interior laterally extending wall 60 is formed to extend between the inner surfaces of the legs 44 and 46 of the yoke 42. The wall 60 is provided with a generally V-shaped slot 62 having an enlarged portion 64 at the apex of the Vee adapted to receive and retain the cord 40 when the yoke 42 is pivoted into a locked position. In the locked position, the yoke 42 prevents passage of the plug member 12 from axial movement which otherwise could result in an electrical disconnection between the plugs 10 and 12 while they will readily permit pivotally movement of the yoke 42 to effect an unlocking.

It will be noted that in the locked position, the slot 54 of the wall 52 and the slot 62 of the wall 60 cooperate to snugly engage the cord 40 at opposite sides of the locking segments 56 and 58 and maintain the yoke 42 in its locked position.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. An electrical plug lock assembly for securing an electrical connection between a pair of plug members comprising:

a first electrical plug member having a main body portion and a pair of opposed bosses extending outwardly from said first plug member main body portion; and a locking yoke having a pair of spaced apart leg members and means for preventing disengagement of said first electrical plug member from another electrical plug member, each said leg member having a socket formed therein receiving an associated one of said bosses for pivotal movement of said locking yoke relative to said first electrical plug member between an unlocked position and a locked position, said means for preventing disengagement including a first wall extending between adjacent ends of said leg members and having a pinching slot formed therein for receiving the second electrical plug member electrical conduit and a second wall extending between said leg members spaced from said first wall and having a slot formed therein for receiving the second electrical plug member electrical conduit whereby when said first electrical plug member is electrically connected to a second electrical plug member having a main body portion with an electrical conduit extending therefrom and said locking yoke is in said locked position, said first electrical plug member main body portion and the second electrical plug member main body portion are positioned between said leg members and said means for preventing disengagement retains the second electrical plug member electrical conduit.

2. The electrical plug lock assembly according to claim 1 wherein said means for preventing disengagement includes a pair of locking segments each being attached to an associated one of said leg members and frictionally engaging the second electrical plug member electrical conduit.

3. The electrical plug lock assembly according to claim 2 wherein said locking segments each have a plurality of generally parallel ribs extending generally perpendicular to a longitudinal axis of the second electrical plug member electrical conduit for frictionally engaging the second electrical plug member electrical conduit.

4. An electrical plug lock assembly for securing an electrical connection between a pair of plug members comprising:

a first electrical plug member having a main body portion and a pair of opposed bosses extending outwardly from said first plug member main body portion; and a locking yoke having a pair of spaced apart leg members and means for preventing disengagement of said first electrical plug member from another electrical plug member, each said leg member having a socket formed therein receiving an associated one of said bosses for pivotal movement of said locking yoke relative to said first electrical plug member between an unlocked position and a locked position, said means for preventing disengagement including a pair of locking segments each being attached to an associated one of said leg members and frictionally engaging the second electrical plug member electrical conduit, each said locking segment having a plurality of generally parallel ribs extending generally perpendicular to a longitudinal axis of the second electrical plug member electrical conduit for frictionally engaging the second electrical plug member electrical conduit a first wall extending between adjacent ends of said leg members and having a pinching slot formed therein for receiving the second electrical plug member electrical conduit, and a second wall extending between said leg members spaced from said first wall and having a slot formed therein for receiving the second electrical plug member electrical conduit whereby when said locking yoke is in said unlocked position, a second electrical plug member having a main body portion with an electrical conduit extending therefrom can be electrically connected to said first electrical plug member, and when said first electrical plug member is electrically connected to the second electrical plug member and said locking yoke is in said locked position, said first electrical plug member main body portion and the second electrical plug member main body portion are positioned between said leg members and said means for preventing disengagement retains the second electrical plug member electrical conduit.

* * * * *